US006050740A

United States Patent [19]

Dziedzic

[11] Patent Number: 6,050,740

[45] Date of Patent: Apr. 18, 2000

[54] COMBINED LOCKDOG AND KELLY BAR ADAPTER

[75] Inventor: Edward Dziedzic, Shelby, Tenn.

[73] Assignee: Dixie Electrical Manufacturing Company, Memphis, Tenn.

[21] Appl. No.: 09/119,341

[22] Filed: Jul. 20, 1998

[51] Int. Cl.[7] ..... B23B 31/10

[52] U.S. Cl. ..... 403/305; 403/306; 403/322.4; 403/324; 405/232; 52/157

[58] Field of Search ..... 403/305, 306, 403/300, 327, 328, 321, 322.1, 322.4, 324, 325, 362; 405/232; 52/155, 157; 175/113, 122, 203, 220

[56] References Cited

U.S. PATENT DOCUMENTS

| | | | |
|---|---|---|---|
| 888,917 | 5/1908 | Lucas . | |
| 1,791,368 | 2/1931 | Mullett . | |
| 2,234,907 | 3/1941 | Williams . | |
| 3,148,510 | 9/1964 | Sullivan | 52/157 |
| 3,318,058 | 5/1967 | Sullivan | 52/157 |
| 3,377,077 | 4/1968 | Hollander et al. | 52/157 |
| 3,832,861 | 9/1974 | Jahnke et al. . | |
| 4,280,768 | 7/1981 | Pardue, Jr. et al. | 52/157 X |
| 4,290,245 | 9/1981 | Pardue, Jr. et al. . | |
| 4,334,392 | 6/1982 | Dziedzic . | |
| 4,467,575 | 8/1984 | Dziedzic . | |
| 4,580,795 | 4/1986 | Burtelson et al. | 52/157 X |
| 4,742,656 | 5/1988 | Farmer . | |
| 4,979,341 | 12/1990 | Norman et al. . | |
| 5,450,914 | 9/1995 | Coram | 175/113 X |

OTHER PUBLICATIONS

Power Installed Screw Anchors_Anchor Installing Wrenches Adapters (B–21).

No Wrench Screw Anchors_Anchor Wrench Adapters (Bulletin 424–C© 1969 A.B. Chance Co.) Chance Torque Indicator.

Introducing J–Claw (Joslyn–Cam Levered Anchor Wrench).

*Primary Examiner*—Lynne H. Browne
*Assistant Examiner*—John R. Cottingham
*Attorney, Agent, or Firm*—Paul M. Denk

[57] ABSTRACT

A combined lockdog and Kelly bar adapter is provided for drivingly connecting a Kelly bar to a shaft of an earth anchor. The adapter includes a unitary one-piece body comprising a first section defining a first socket sized and shaped to receive a Kelly bar and a second section defining a second socket sized and shaped to receive the shaft of the earth anchor. A flange is formed in the first socket and has an inner wall having a smaller circumference than the wall of the first socket, so that the adapter can receive two different sized Kelly bars. A spring biased pin is provided to engage a hole in the earth anchor shaft to axially fix the adapter relative to the earth anchor shaft. The pin includes a sloped surface which is engaged by the earth anchor shaft, so that the adapter can be applied to the earth anchor shaft simply by sliding the adapter over the earth anchor shaft. The adapter includes a camming surface and a ring through an outer end of the pin. The ring and the camming surface cooperate to selectively position the pin radially in the adapter relative to the anchor shaft.

4 Claims, 3 Drawing Sheets

COMBINED LOCKDOG AND KELLY BAR ADAPTER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to locking dogs and Kelly bar adapters which are used to drivingly connect the shaft of an earth anchor to a Kelly bar.

When utility poles are erected, they are often provided with guy wires to stabilize the poles. The guy wires are connected, at their bottom ends, to earth anchors which have been driven into the ground. Typically, the earth anchor is operatively connected to a Kelly bar, which in turn is driven by an hydraulic motor. The motor turns the Kelly bar and earth anchor to drive the anchor into the ground. After the anchor is driven into the ground, the Kelly bar is disconnected from the earth anchor shaft.

In the past, the lack of standardization by utility truck manufacturers on Kelly bar sizes, as well as multiple uses of the installing vehicles and tools, led designers to offer a Kelly bar adapter with a bolted flange so that one Kelly bar could be used with multiple tools. However, many different Kelly bar adapters had to be developed for the variations in Kelly bar sizes and types. The use of the flanged adapter also enabled the use of mechanical in-line torque indicators. Earth anchors are driven into the ground under a desired amount of torque. Obviously, the application of too much torque to the earth anchor and its shaft can damage the shaft. The in-line torque indicator allowed the torque applied to the earth anchor to be controlled, so that it would not exceed a certain desired amount. A common assembly for driving an earth anchor A into the ground is shown in FIG. 1. A locking dog D is fixed to the top of the wrench tube W which surrounds the earth anchor's shaft S. The locking dog D has a plate on its top, and an in-line torque indicator T is bolted to the locking dog plate. A Kelly bar adapter B having a bottom plate is bolted to the top of the torque indicator T, and a Kelly bar K is received in the Kelly bar adapter B. Thus the rotation of the Kelly bar K is transmitted to the anchor A by way of the Kelly bar adapter B, the in-line torque indicator T, and the locking dog D.

Over the years, Kelly bar sizes have been standardized, reducing the need for adapters. However, bolted connections, such as shown in FIG. 1, between the Kelly bar adapter B, the torque indicator T, and drive adapter or locking dog D continued to be used. This has continued, even though the use of the bolted connections create problems. The bolted connections reduce the strength and integrity of the Kelly bar/drive shaft connection, a connection which is highly stressed and requires properly installed high grade-bolts to make a reliable connection. Further, field personnel often do not have access to sufficient quantities of high-grade bolts, and are forced to use weaker bolts. Additionally, the torque indicators are difficult and time consuming to install, and thus are rarely used. When not used, the earth anchor can be improperly driven into the ground. Lastly, the cost of field labor and the high expenses of maintaining the installing vehicles made it expensive to assemble, disassemble, and maintain the various tools needed for an anchor installation.

BRIEF SUMMARY OF THE INVENTION

Briefly stated, a combined lockdog and Kelly bar adapter is provided for drivingly connecting a Kelly bar to a wrench tube and shaft of an earth anchor. The adapter includes a unitary one-piece body comprising a first section and a second section. The first section defines a first socket sized and shaped to removably receive the Kelly bar. The second section defines a second socket sized and shaped to removably receive the earth anchor wrench tube. A flange is formed in the first socket and has an inner wall having a smaller circumference than the wall of the first socket. The use of the flange allows the adapter to receive two different size Kelly bars, so that one adapter can be used with two different Kelly bars.

The adapter includes a radially extending pin which extends into the second socket to engage the anchor to axially fix the anchor to the adapter. The pin is shaped, at its end, to extend through a hole in the wrench tube and to engage the earth anchor shaft to positively hold the earth anchor shaft and the adapter relative to each other. Preferably, the pin has a shaft and an enlarged head, and the head and pin shaft together define a pin shoulder. The head has a lower surface which is sloped, such that the end of the head is of a small circumference, and can be received in the anchor shaft hole. The pin can be positioned in three different positions: (1) out of engagement with the anchor shaft and the wrench tube; (2) in engagement with the wrench tube, but not the earth anchor shaft; and (3) in engagement with both the wrench tube and the earth anchor shaft.

The pin is slidably received in a sleeve, which in turn is removably and slidably received in a hollow arm. The sleeve, which is opened on both ends, has a shoulder formed at its outer end. A spring is positioned between the sleeve shoulder and the pin shoulder to bias the pin inwardly into the second socket.

The sleeve is removably received in the arm, and the adapter includes a fastener to positionally fix the sleeve in the arm. Preferably, the fastener is a screw, and the arm includes a screw hole which extends through an arm of the wall. The screw then extends through the screw hole to engage the outer wall of the sleeve. Preferably, the sleeve has a depression in the outer wall which receives the screw so that the sleeve will be positively engaged by the screw. Preferably, the arm bore and the sleeve are keyed to align the sleeve depression with the arm fastener passage.

To help orient the pin in the sleeve, so that the sloped surface of the pin head will face downwardly, the pin includes a ring at its outer end and the sleeve includes a pair of spaced apart walls defining a gap therebetween. The gap is sized to receive the pin ring, and oriented such that when the ring is received in the gap, the pin head sloped surface will face downwardly. The just-noted walls are preferably arced and are generally semi-circular. They are also sloped from one end of the wall to another. By positioning the ring at the high end of the wall, in the middle of the wall, or in the gap, the pin is placed in the three different positions relative to the wrench tube and the anchor shaft.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 7:
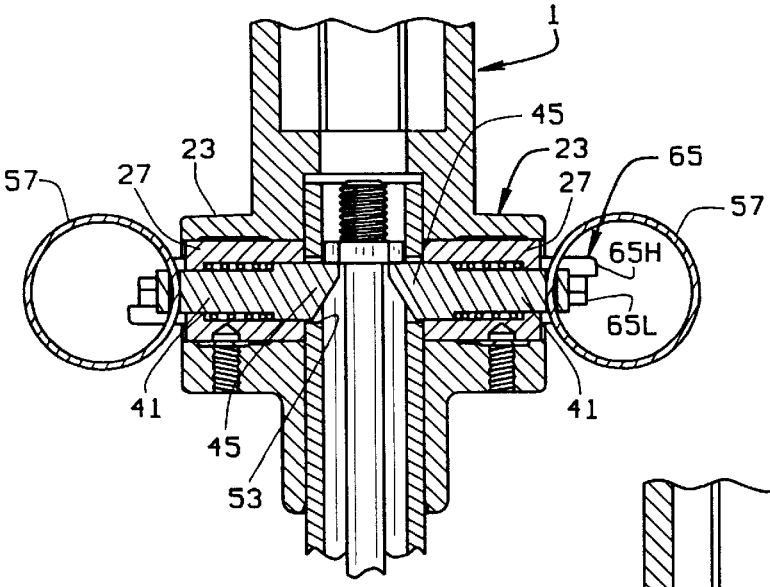
FIGS. 7–9 are enlarged, fragmentary cross-sectional views of the adapter showing the three positions of the pin of the adapter relative to the wrench tube and shaft of the anchor.
Figure 8:
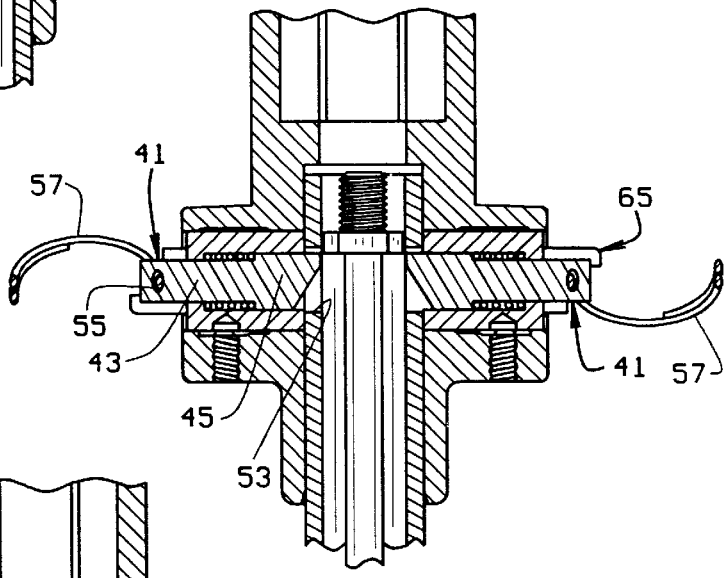
Figure 9:
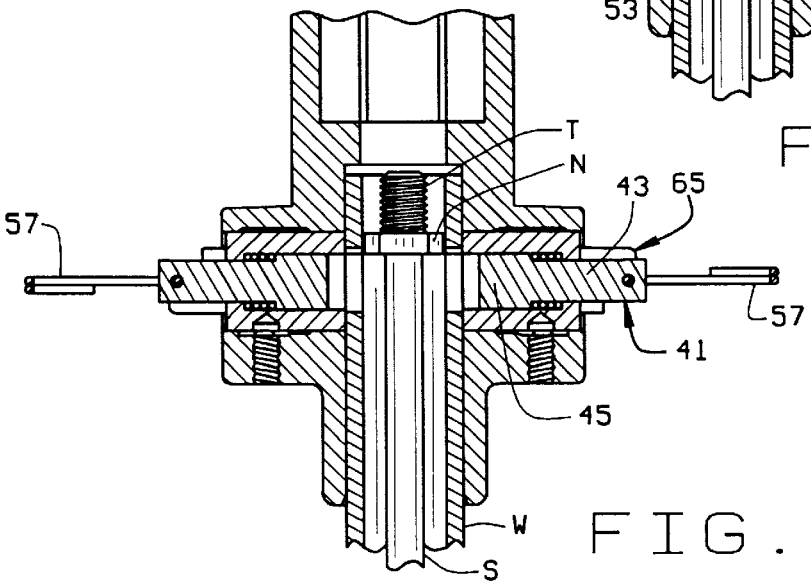

Turning briefly to FIGS. 7–9, the anchor includes the wrench tube W which surrounds the shaft S. The anchor shaft S is threaded at its top, as at T, to accept a nut N. The nut N is attached to the shaft S, which in turn, is attached to the earth anchor A. The earth anchor A has a short square shaft sized and shaped to correspond to the inner surface of the wrench tube W, thus preventing the anchor or shaft from rotating relative to the wrench tube.

Figure 1:
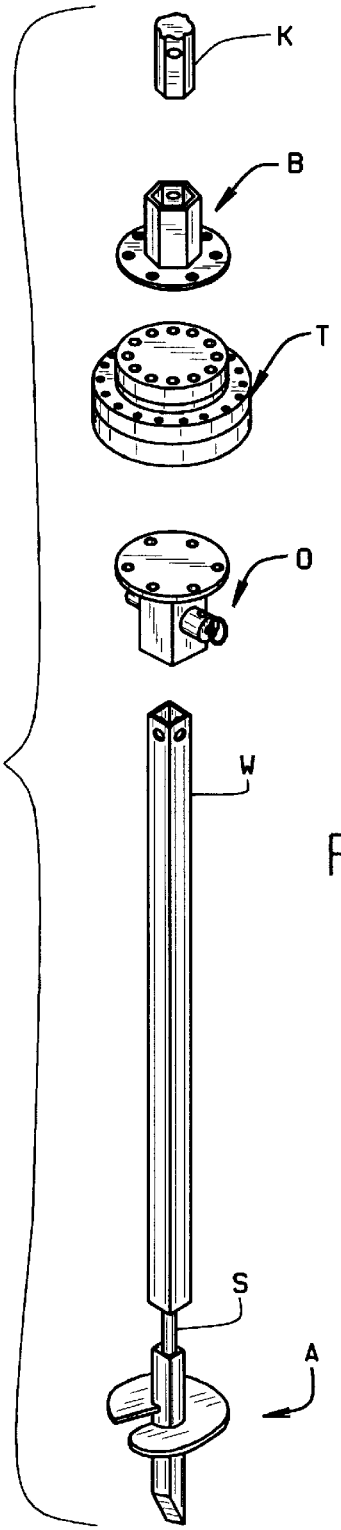
FIG. 1 PRIOR ART
FIG. 1 is a perspective, exploded view of a prior art connection between a Kelly bar and an earth anchor shaft, including an in-line torque indicator.
Figure 5:
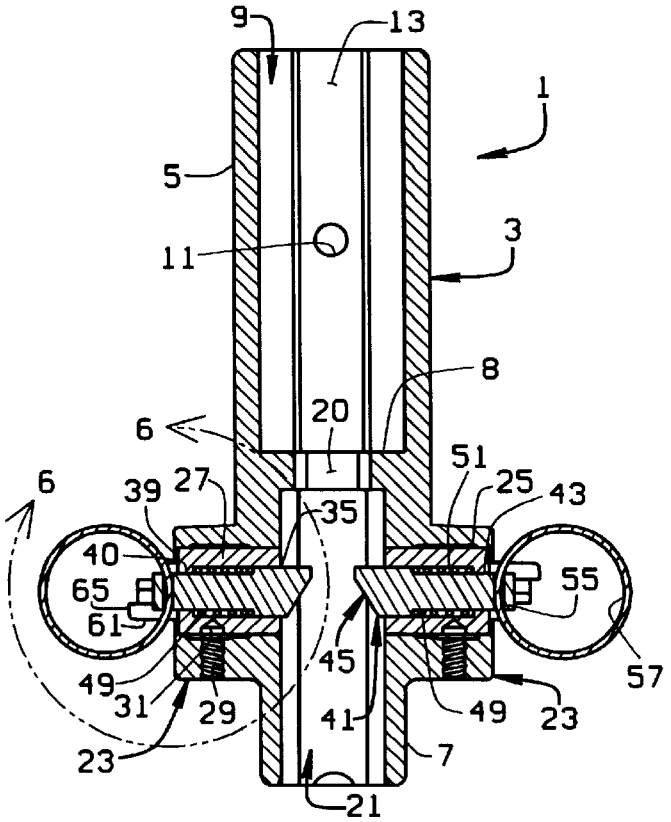
FIG. 5 is a vertical cross-sectional view of the adapter taken along line 5—5 of FIG. 4.
Figure 4:
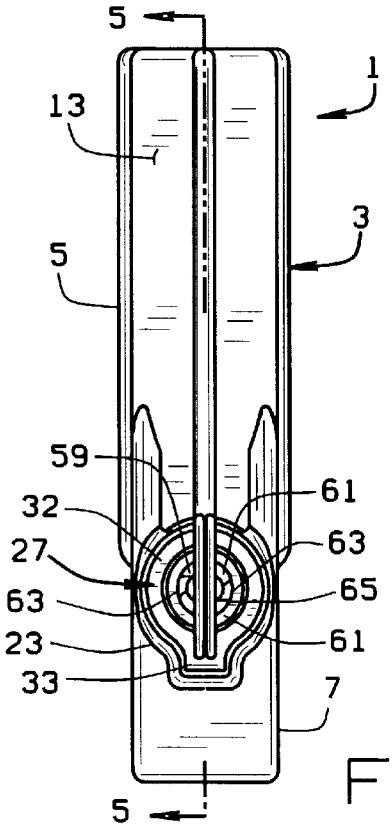
FIG. 4 is a side elevational view of the adapter.
Figure 6:
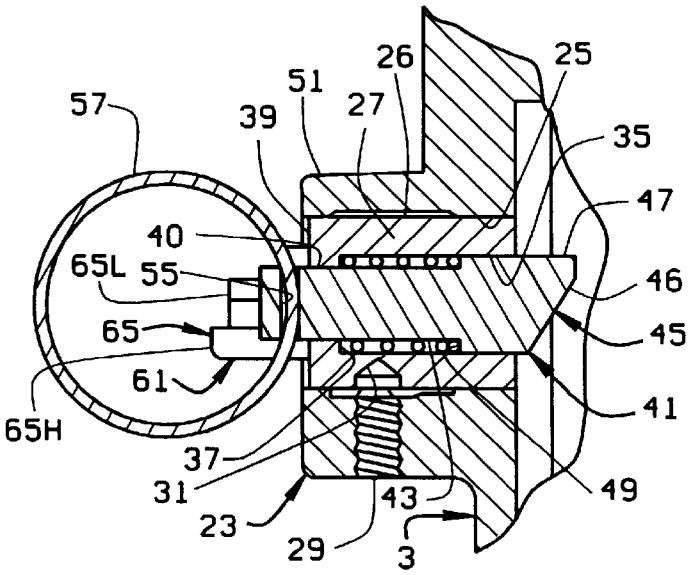
FIG. 6 is an enlarged cross-sectional view taken along line 6—6 of FIG. 5.

A combined piece Kelly bar adapter and locking dog 1 is provided for connecting a Kelly bar K to the wrench tube W, and through the wrench tube W to the short square shaft of the earth anchor A. (See the bottom of FIG. 1). The connector 1 (FIGS. 3–6) includes a hollow unitary one-piece body 3 having an upper portion 5 and a lower portion 7. The body 3 is preferably cast of metal or other material which can withstand the high torques to which the connector 1 will be subjected. The upper and lower sections 5 and 7 are separated by an internal flange or shoulder 8. (FIG. 5).

Figure 2:
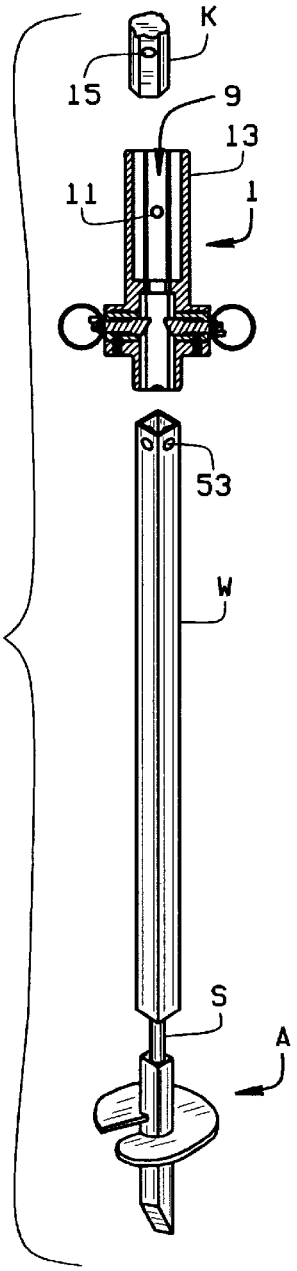
FIG. 2 is an exploded view of a combined Kelly bar and locking dog adapter of the present invention with an associated Kelly bar and earth anchor shaft
Figure 3:
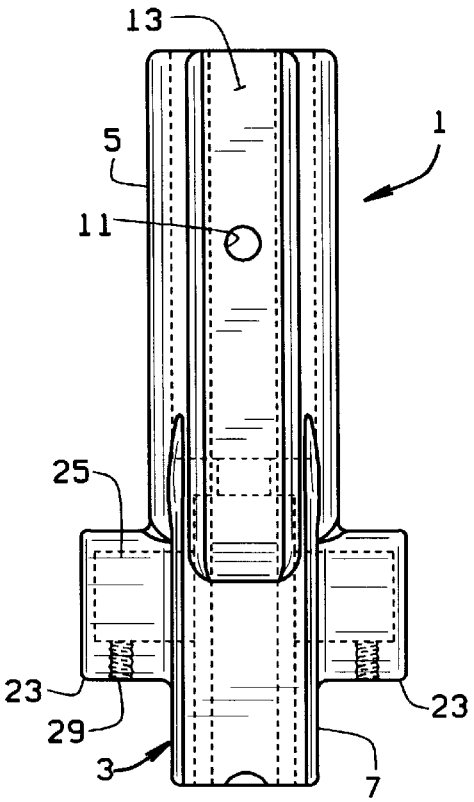
FIG. 3 is a front elevational view of the adapter.

The upper portion 5 is hollow, defining a socket 9 sized and shaped to receive a Kelly bar K. The socket 9 is shown to be hexagonal to receive the hexagonally shaped Kelly bar K shown in FIG. 2. However, the socket could be any other cross-sectional shape, corresponding generally to the cross-sectional shape of the Kelly bar, so that it can properly receive the Kelly bar. Thus, the walls of the Kelly bar will engage the walls of the socket 9 to facilitate the transfer of rotation from the Kelly bar to the connector 1. A hole 11 is formed in the wall 13 which defines the socket 9. The hole 11 extends through the upper section 5 and is positioned to be aligned with a hole 15 (FIG. 2) in the Kelly bar K. A pin (not shown) is passed through the upper section hole 11 and Kelly bar hole 15 to axially position the Kelly bar K in the combined Kelly bar adapter/locking dog 1. The hole 11 in the upper portion 5 is positioned a distance from the flange 8 corresponding generally to the distance of the Kelly bar hole 15 from the bottom of the Kelly bar. Thus, the adapter 1 can be placed over the Kelly bar K until the shoulder comes into contact with the Kelly bar. At this point, the holes 11 and 15 will be aligned to easily slide the pin through the connector 1 and Kelly bar K.

The connector 1 is designed to accept a single size of Kelly bar, but can be modified to accept the two most common sizes of Kelly bars. The shoulder 8, as seen best in FIG. 5, has a hexagonal surface 20 defining a smaller diameter opening. The dimension (i.e. size and shape) of the inner surface of the wall 13 corresponds generally to the size and shape of a larger Kelly bar, and the dimension of the surface 20 corresponds to the size and shape of a smaller Kelly bar. Thus, the connector 1 can be used with either type Kelly bar, eliminating the need for a different connector for each Kelly bar. If the smaller Kelly bar is used, it is simply slid down further into the body 3, so that the Kelly bar will be in alignment with the surfaces 20 of the shoulder 8. The surfaces of the smaller Kelly bar will thus engage the surfaces 20 of the shoulder 8 to transfer the rotation of the Kelly bar to the connector 1. By making the surfaces 20 longer, similar in length to the inner surface of the wall 13, the surface 20 will be long enough to hold the smaller Kelly bar, and transmit torque to the smaller Kelly bar.

The lower portion 7 of the combined Kelly bar adapter/locking dog is also hollow and defines a socket 21 which is sized and shaped to receive the top of the earth anchor wrench tube W. The socket 21 is shown to be square in cross-section to conform generally to the square cross-sectional shape of the earth anchor wrench tube W shown in FIG. 2. Again, as with the socket 9, the socket 21 can be made any desired cross-sectional shape, as long as the socket 21 corresponds generally to the size and shape of the wrench tube W. As with the Kelly bar K and the socket 9, the walls of the socket 21 will engage the walls of the wrench tube W to transfer rotation from the connector 1 to the wrench tube W and hence to anchor A. As will be described below, a pin 41 is used to axially fix the wrench tube W and the anchor shaft S in the socket 21. However, because pins are not relied on for rotationally fixing the Kelly bar K, the connector 1 and the wrench tube W relative to each other, the amount of torque which can be applied to the anchor is limited by the design of the adapter body 3, and not by the strength of pins.

Identical side arms 23 extend from opposite sides of the lower portion 7. The side arms 23 are hollow, and define a bore 25 which is at a right angle to, and communicates with the lower section socket 21. The bore 25 is preferably recessed, as at 26. A hollow sleeve 27 is slidingly and removably received in the bore 25. The sleeve 27 is positionally fixed in the bore 25 by a screw (not shown) which extends inwardly through the arm 23 to contact the sleeve 27. The arm 23 includes a screw hole 29 through which the screw extends. Preferably, the sleeve 27 includes a small depression 31 into which the screw extends. Thus, the screw positively engages the sleeve 27 to secure the sleeve in the arm, rather than relying on a frictional engagement between the sleeve 27 and the screw. To facilitate alignment of the sleeve depression 31 and the arm screw hole 29, the arm bore 25 and sleeve 27 are keyed. The sleeve has a generally circular body 32 with a key or rib 33 at the bottom thereof. The arm bore 25 is shaped similarly to the sleeve 27 to slidingly receive the sleeve 27. This provides for proper orientation of the sleeve 27 in the arm bore 25 so that the sleeve depression 31 can be easily aligned with the arm screw hole 29. Any other conventional means can be used to removably secure the sleeve 27 in the arm bore 25.

The sleeve 27, as noted, is hollow and defines a bore 35 which communicates with the connector lower portion socket 21. A flange 37 is formed at the back wall 39 of the sleeve 27 and defines an opening 40 into the bore 25. A pin 41 is slidingly received in the sleeve bore 35. The pin 41 includes a shaft 43 which is sized to fit through the opening 40. An enlarged head 45 is formed at the end of the shaft 43. The pin head 45 has a sloping lower surface 46 and a flat upper surface 47. The pin is sized such that the head 45 extends into the connector lower portion socket 21. The head 45 and shaft 43 define a shoulder 49 (FIG. 6) at the back of the head. A spring 51 is positioned between the pin shoulder 49 and the sleeve shoulder 37 to bias the pin 41 inwardly into the socket 21. At least the end of the pin head 45 is sized and shaped to be received in the holes 53 (FIG. 2) in the top of the earth anchor shaft S.

When the connector is applied to the wrench tube W and the earth anchor shaft S, the connector is simply slid over the wrench tube W with the pins 41 in generally the same plane as the wrench tube holes 53. As the top of the wrench tube W contacts the sloped surfaces 46 of the pin heads 45, the shaft will push the pins 41 outwardly, against the bias of the springs 51. When the pin heads 45 and the wrench tube holes 53 come into alignment, the springs 51 will push the pins 41 inwardly such that the pin heads extend at least partially into the shaft hole 53. The pin 41 thus interacts with the wrench tube W to secure the adapter 1 to the wrench tube W. As seen in FIGS. 7, when the anchor shaft S is received in the wrench tube W and the wrench tube W is received in the adapter 1, the pin head 45 extends through the wrench tube hole 53 to be below the anchor shaft nut N. The nut N thus sits on top of the pin head 45. The pin head 45 thus prevents the anchor shaft S from moving axially relative to the wrench tube W. The pin 41 therefore not only locks the wrench tube W in the adapter 1, but locks the anchor shaft S in the wrench tube W.

The pin 41 includes a bore 55 at its back end through which a ring 57 passes. The ring provides for a pull, such that the pin 41 may be pulled out of engagement with the shaft S so that the connector 1 can be removed from the shaft, as discussed below.

The sleeve 27 additionally includes two arced walls 61 which extend outwardly from the back surface 39 of the sleeve. The two walls 61 are separated by a pair of oppositely positioned gaps 63 sized to receive the ring 57. Preferably, the walls 61 have sloped back surface 65 defining a high end 65H and a low end 65L of the walls 65. The walls 61 provide a rest for the rings 57. When the pin is engaged with the shaft, the ring 57 is received in the gaps 63 between the walls 61. The walls 61, and their associated gaps 63, thus help ensure a proper orientation of the pin head 41. When the pin 41 is pulled out of the shaft holes 53, the pin 41 can be rotated, such that the pin rests on the outer surface 65 of the walls 61. In this way, the pins can be pulled out of engagement with the shaft S one at a time. When both pins are pulled out of engagement, then the connector can be removed from the shaft S.

As shown in FIGS. 7–9, the rotational position of the ring 57 relative to the walls 61 will position the pin axially radially to the wrench tube W and anchor shaft S. In FIG. 7, the ring 57 is shown received in the gap between the walls 65. In this position, the pin extends fully through the wrench tube W such that its head is positioned beneath the anchor nut N so that the pin engages both the wrench tube W and the anchor shaft S. In this position, the pin is holding together the anchor shaft S, the wrench tube W, and the adapter 1, and the connection between the adapter 1 and the anchor A is ready so that the anchor A can be driven into the ground.

In FIG. 8, the ring 57 is rotated so that it rests on the walls 65 at a point approximately midway between the low and high ends 65L,H of the walls 65. In this position, the pin head 65 is positioned to extend into the wrench tube hole 53, but is not positioned directly beneath the anchor shaft nut N. Thus, the pin is in engagement with the wrench tube W but out of engagement with the anchor shaft S. In this second position, the operator can use the adapter 1 to remove the wrench tube W from the anchor shaft S after the anchor shaft has been driven into the ground.

Lastly, In FIG. 9, the ring 57 is shown rotated to rest on the high end 65H of the wall 65. In this position, the pin 41 is out of engagement with the wrench tube W (and the anchor shaft S). This third position allows for the adapter 1 to be placed over, or removed from, the wrench tube W.

The wall 65 thus defines a camming surface which is used to insert the pin into, and extract the pin from, the wrench tube and the anchor shaft S. The pin can thus be rotated relative to the wall 65, and the pin and wall will cooperate to move the pin 41 radially relative to the adapter 1, wrench tube W, and shaft S. Further, the interaction of the wall 65 and the ring 57 will hold the ring 57 in a desired position. This facilitates connection and disassembly of the adapter-wrench tube-anchor shaft assembly, and the adapter, wrench tube, and shaft can be assembled and disassembled fairly quickly and easily by a single person.

As can be appreciated, the connector 1 of the present invention eliminates the use of bolts in connecting the Kelly bar K to the earth anchor shaft S. Thus, connection of the Kelly bar to the shaft S is made much easier, and the time it takes to connect (and disconnect) the Kelly bar from the anchor shaft is greatly reduced. Because bolts are not needed, the rating of the connector is governed by its design, rather than bolts. Thus, the connector can be rated for higher torques than can be achieved with the use of bolts.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

I claim:

1. A combined lock dog and Kelly bar adapter for drivingly connecting a Kelly bar to a wrench tube and shaft of an earth anchor, the earth anchor shaft being received within the wrench tube; and adapter including a unitary one-piece body comprising:

a first section defining a first socket sized and shaped to removably receive the Kelly bar;

a second section defining a second socket sized and shaped to removably receive the earth anchor shaft;

a pin which extends radially into the second socket, the pin being sized to extend through an opening in the wrench tube to engage the anchor shaft to axially fix the anchor shaft in the adapter; the pin being biased inwardly into the second socket by a spring element; the pin being rotatable in a bore in the adapter; the pin being brought into and out of engagement with the anchor shaft and the wrench tube by rotation of the pin; the Kelly bar adapter including a camming surface for selectively positioning said pin relative to said anchor shaft; and said camming surface comprising a sloping wall extending radially outwardly from an outer surface of said adapter, said pin including a ring which rides on said wall, said ring cooperating with said wall to selectively position said pin relative to said anchor shaft.

2. The combined lockdog and Kelly bar adapter of claim 1 wherein said pin is selectively movable by rotation of the pin between a position in which said pin is operatively engaged with both said wrench tube and said earth anchor shaft, a position in which said pin is operatively engaged with only said wrench tube, and a position in which said pin is out of engagement with both said wrench tube and said earth anchor shaft.

3. The combined lockdog and Kelly bar adapter of claim 1 wherein said pin includes a pin shaft and a head at an inner end of said pin; said head and said pin shaft defining a pin shoulder; said head being shaped, at its end, to be received in a hole in said earth anchor shaft to axially removably fix said earth anchor shaft in said adapter.

4. The combined lockdog and Kelly bar adapter of claim 3 including a hollow arm extending radially from said body; said arm defining an arm bore which communicates with said second socket; and a hollow sleeve slideably received in said arm bore, said sleeve receiving said pin; said arm having an inner end, an outer end, and a shoulder formed adjacent said sleeve outer end; said spring being positioned between said sleeve shoulder and said pin shoulder.

* * * * *